US006263646B1

(12) United States Patent
Spina et al.

(10) Patent No.: US 6,263,646 B1
(45) Date of Patent: Jul. 24, 2001

(54) APPARATUS AND METHOD FOR OPENING A PERFORATED ARTICLE SUCH AS A CORRUGATED BOX

(75) Inventors: John A. Spina, Hamlin; John DePoint, Jr., Palmyra; Marion T. Juskiewicz, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/430,455

(22) Filed: Oct. 29, 1999

(51) Int. Cl.[7] ..... B65B 43/40
(52) U.S. Cl. ..... 53/492; 53/381.1; 53/381.4
(58) Field of Search ..... 53/492, 50, 381.2, 53/382.1, 381.4, 381.1; 225/94, 96, 96.5

(56) References Cited

U.S. PATENT DOCUMENTS 3,889,442 * 6/1975 Grahn et al. ..... 53/381.2
3,903,677 * 9/1975 Bowman et al. ..... 53/381.1
4,817,260 * 4/1989 Martin ..... 53/492
5,361,562 11/1994 Nagaoka et al. ..... 53/492
5,407,116 * 4/1995 Nishishita et al. ..... 225/96.5
5,452,506 * 9/1995 Biedermann et al. ..... 53/381.4
5,568,750 * 10/1996 Galen ..... 53/382.1
6,050,063 * 4/2000 Ford et al. ..... 53/381.1

* cited by examiner

*Primary Examiner*—Ira S. Lazarus
*Assistant Examiner*—Sam Tawfik
(74) *Attorney, Agent, or Firm*—Clyde E. Bailey, Sr.

(57) ABSTRACT

An apparatus for bursting perforations on an article, such as a corrugated box, has a rotatable, retractable burst member that exerts an impact force on opposing sides of end portions of the perforated lid. Burst member is arranged for vertical movement towards an end portion of the perforated lid and then rotatable movements to opposing sides of the perforated lid. The article is positioned in a plane substantially perpendicular to the movement of the burst member so that the burst members can engageably contact end portions of the perforated lid with a predetermined impact force. A separator is used to capture the perforated lid and then retract for separating the perforated lid from the main portion of the article.

7 Claims, 6 Drawing Sheets

APPARATUS AND METHOD FOR OPENING A PERFORATED ARTICLE SUCH AS A CORRUGATED BOX

The present application is related to U.S. application Ser. No. 09/430,573, filed Oct. 29, 1999, by John A. Spina, et al., and entitled, "Method Of Opening A Perforated Article;" and U.S. application Ser. No. 09/430,581), filed Oct. 29, 1999, by John A. Spina, et al., and entitled, "Apparatus And Method For Bursting Perforations On An Article."

FIELD OF THE INVENTION

The invention relates generally to the field of perforated articles, and in particular to an apparatus for bursting perforations in the article, such as a corrugated box, for accessing the interior without damaging the article.

BACKGROUND OF THE INVENTION

Packages having perforations that must be broken to access the interior compartment are widely used in the product supply chain. The shipment of some photosensitive products, such as X-ray film, is widely accomplished in corrugated boxes having a perforated lid for accessing the X-ray film product therein. The perforations along the perforated lid and the main body of the corrugated box must be at least partially burst so that access to the product can be easily achieved. Presently, such perforations along the perforated lid are burst by any one of several ways including manually by hand or by equipment that applies opposing forces to an end of the corrugated box body and the perforated lid. In some instances, product such as X-ray film may be shipped in a corrugated box having the perforated lid pre-separated from the main body of the box. However, experience indicates that each of the aforementioned practices of shipping products in a package with a perforated lid has well known shortcomings and, therefore is undesirable for select applications, such as where an adhesive product label is used to rejoin the separated perforated lid with the main box body.

Removing the perforated box lid manually by hand is known to introduce unacceptable ergonomic problems for the operator. Suppliers who ship the corrugated boxes with the perforated lid removed introduce an expensive alternative because the product, i.e., the X-ray film, would have to be introduced into the box and then a product label applied. Moreover, in this latter instance, the perforated lid may not properly align with the main body of the corrugated box when it is desirable to reseal the box.

Known methods and apparatus for opening a lid of a box include that disclosed in U.S. Pat. No. 5,631,562 by Nagaoka et al., Nov. 8, 1994, and titled, "Method and Apparatus For Opening Lid Of Box" in which a gas is injected into the upper lid of the box that causes the lid to separate from the body of the box. Nagaoka et al., however, does not teach or suggest removing a perforated lid from a corrugated box.

Therefore, there persists a need for an apparatus and method for bursting perforations on an article, such as a corrugated box, that solves the aforementioned problems in the art.

SUMMARY OF THE INVENTION

It is, therefore, an object of the invention to provide an apparatus that can burst perforations in a corrugated box by applying a controlled impact force to a portion of the perforated lid.

It is another object of the invention to provide an apparatus that uses a single rotatable burst member for bursting perforations arranged on the box.

Yet another object of the invention is to provide an apparatus that can separate the perforated lid once the perforations are burst.

It is a feature of the invention that a single burst member exerts a predetermined impact force on opposing sides of a portion of the corrugated box near the perforations. A retractable separator member then grasps the perforated lid with perforations at least partially burst and, upon retracting, separate the perforated lid from the main body of the corrugated box.

To achieve one or more of the objects, features and advantages of the invention, there is provided in one aspect of the present invention, an apparatus for bursting perforations on an article having a main body portion and a perforated lid, said perforated lid being separable from said main body portion at perforations along the periphery of said main body portion, said apparatus comprising:

a frame having a substantially flat, movable surface for supporting said article with said perforations exposed for impact;

means for securing said article to said substantially flat, moveable surface; a rotatable, retractable burst member arranged for rotating around said article to a predetermined position relative to said perforations and for engageably contacting said article so as to apply a predetermined impact force on said perforations at said predetermined position to form at least partially burst perforations;

a retractable separator member arranged in said frame for capturing said perforated lid and then separating said perforated lid from said main body portion at said at least partially burst perforations;

means for moving said retractable burst member into engaging contact with said perforations of said perforated lid for bursting perforations nearest to said retractable burst member and then for rotating said retractable burst member to a second position for engaging contact with remaining perforations;

means for moving said retractable separator into a first position capturing said perforated lid about said partially burst perforations and then to a second position separating said perforated lid from said main body portion of said article.

In another aspect of the invention, there is provided a method of opening a corrugated box having a perforated lid and a main body, said main body being separable from said perforated lid by perforations, said method comprising the steps of:

providing the apparatus recited above;

positioning said article on said substantially flat, moveable surface so as to expose said perforations to an impact force;

moving said substantially flat, moveable surface having said article thereon into a first position proximate to said retractable burst member;

moving said retractable burst member into engaging contact with an end portion of said perforated lid thereby forming at least partially burst first perforations;

retracting said retractable burst member from said perforated lid;

rotating said retractable burst member to an opposite side of said perforated lid;

moving said retractable burst member into engaging contact with an opposing end portion of said perforated lid thereby forming at least partially burst second perforations;

retracting said retractable burst member from said perforated lid;

moving said retractable separator into a first position capturing an end of said perforated lid; and, retracting said retractable separator to a second position thereby separating said perforated lid from said main body portion at said at least partially burst first and second perforations.

It is, therefore, an advantage of the present invention that the process and apparatus are simple to produce and use, cost effective and far more reliable than present developments.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
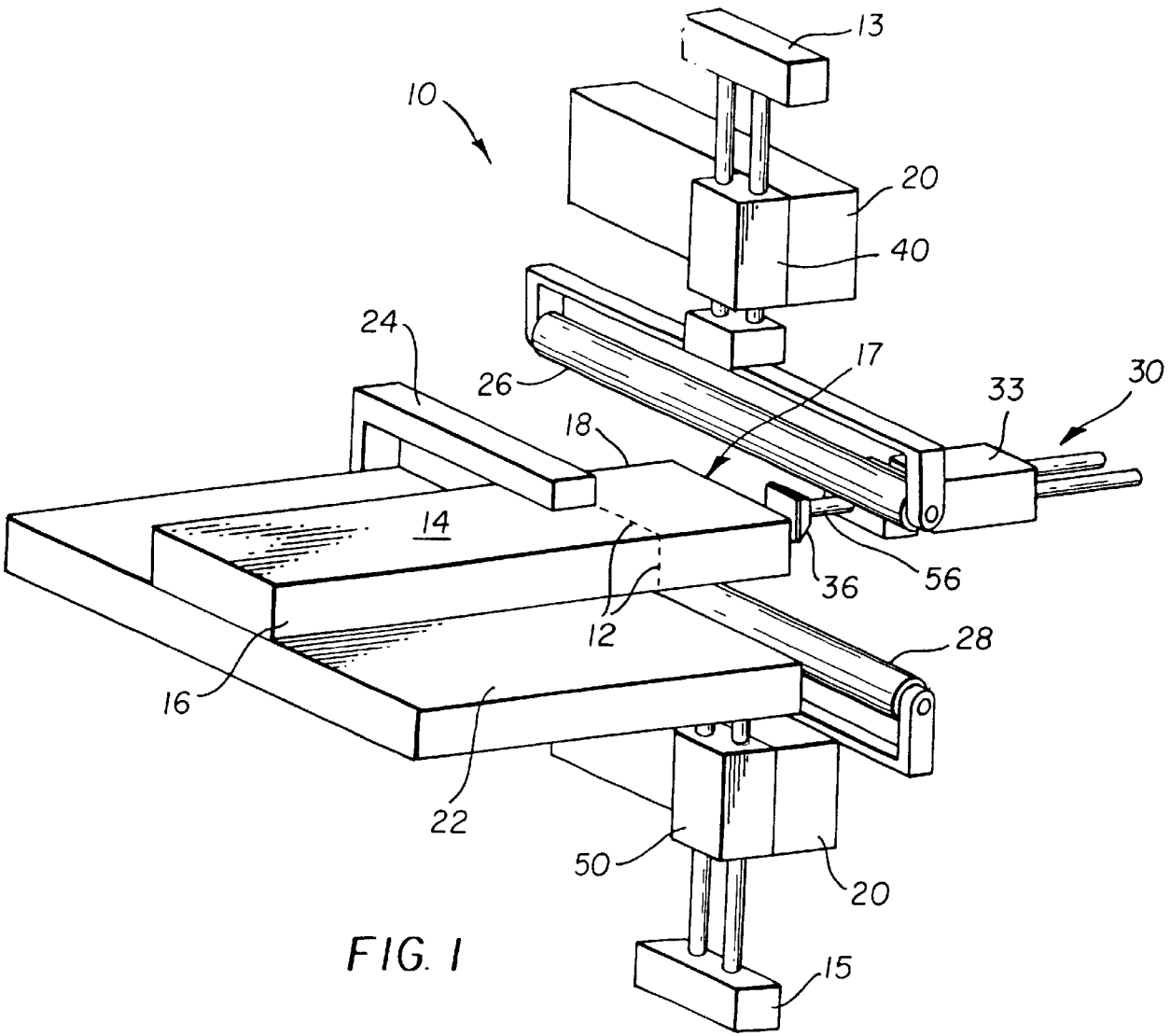
FIG. 1 is an exploded view of the apparatus of the invention.

Turning now to the drawings, and in particular to FIGS. 1–4, apparatus 10 for bursting perforations 12 on an article, such as a corrugated box 14 for storing X-ray sheet film, is illustrated. Generally, corrugated box 14 has a main body portion 16 and a perforated lid 18 separable from the main body portion 16 at perforations 12 along the periphery of the main body portion 16. Generally, apparatus 10 is used to separate or remove the perforated lid 18 from the main body portion 16. In an alternative embodiment, apparatus 10 is used to detect the separation of the perforated lid 18 from the main body portion 16. In yet another embodiment of the invention, apparatus 10 is used to replace the removed perforated lid 18 back onto a sleeve portion (not shown) of the main body portion 16 of the box to allow the perforated lid 18 to be easily removed by the end user.

Broadly defined apparatus 10 includes a frame 20 having a substantially flat, movable surface or platform 22 for supporting the box 14 with the perforations 12 exposed to receive an impact force. A clamp 24, or other similar means, is used to secure the box 14 to the substantially flat, moveable surface or platform 22 while the box 14 is experiencing an impact force.

Figure 2:
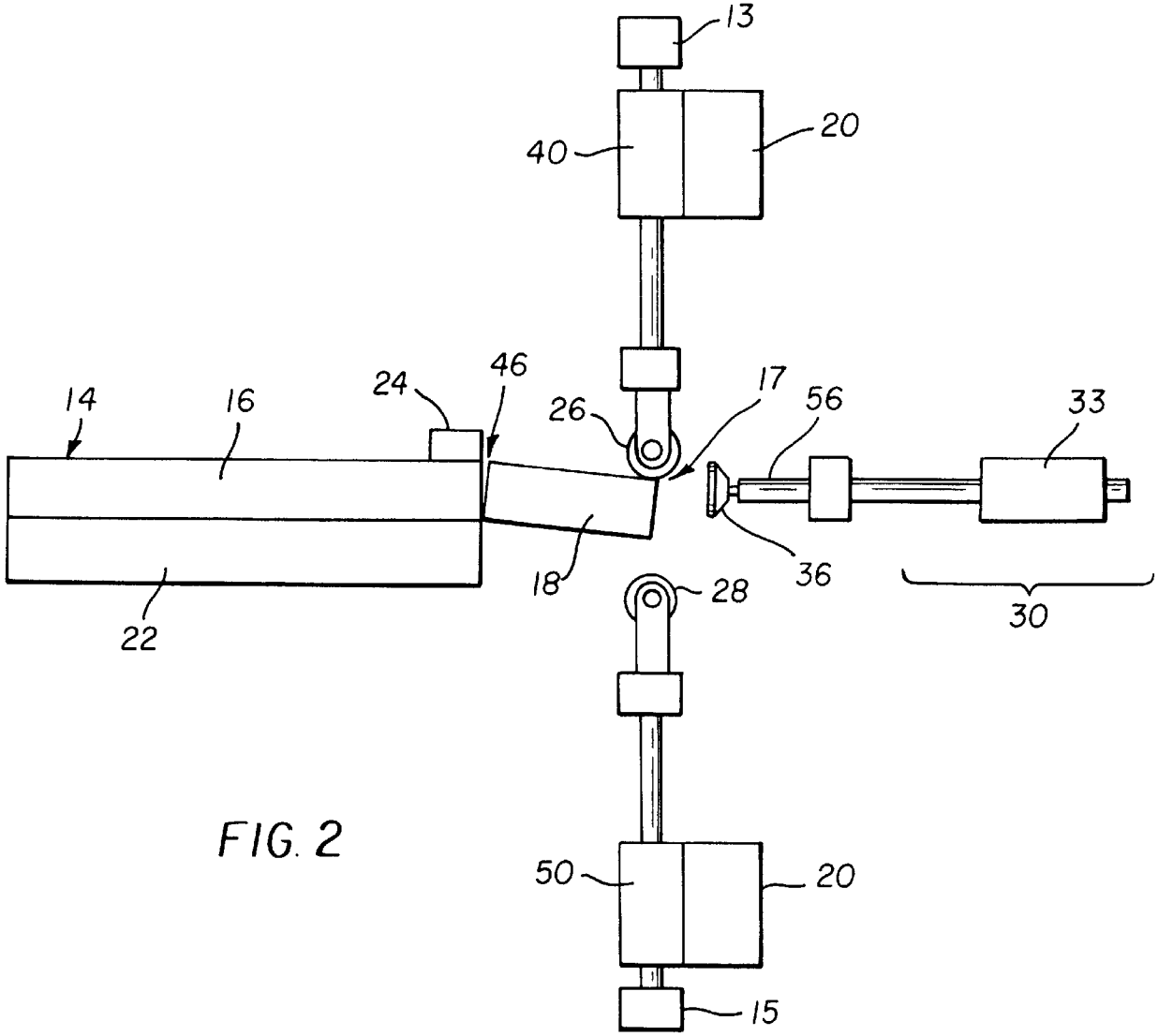
FIG. 2 is a partial section view of the separator member capturing a box.
Figure 3:
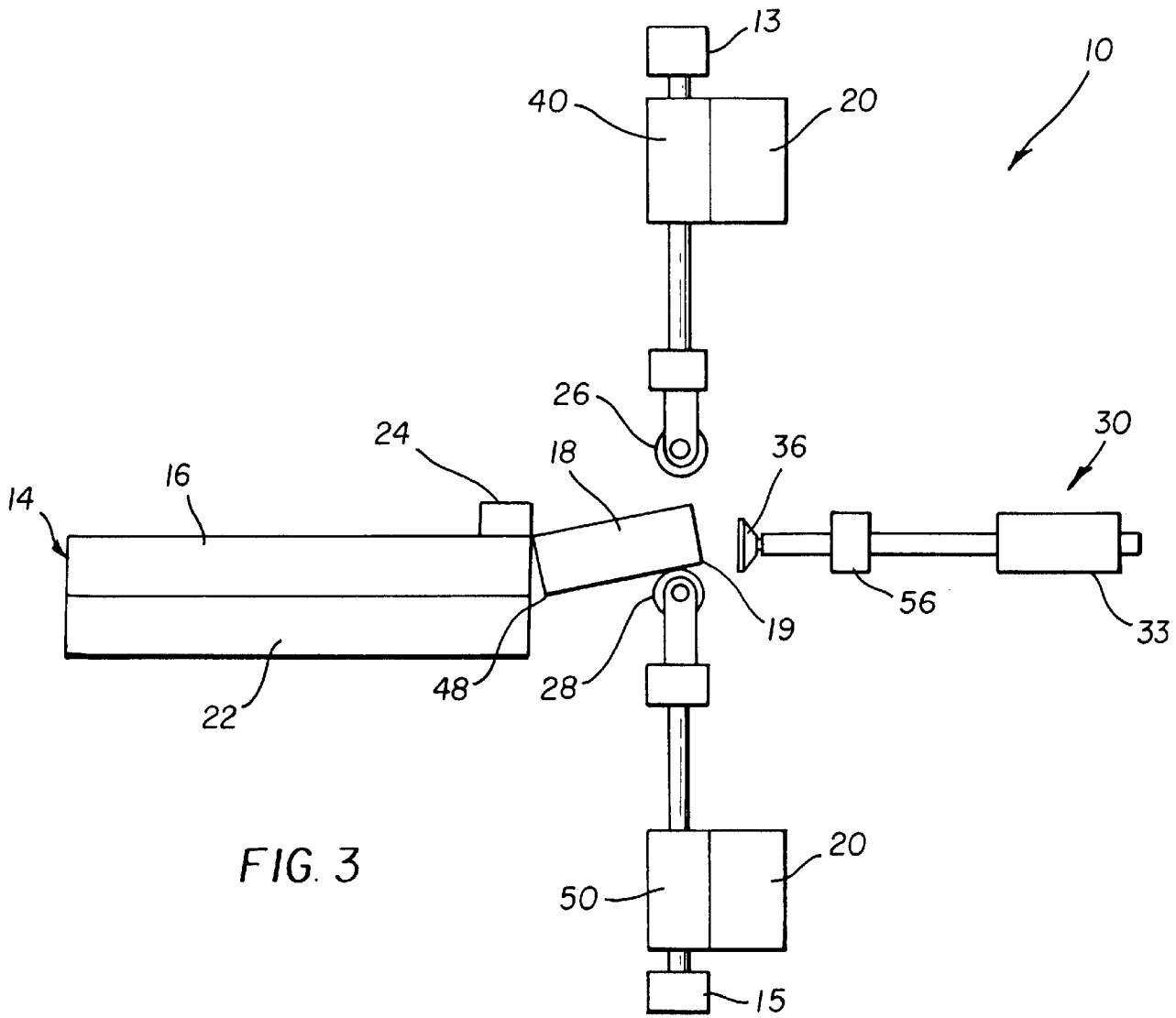
FIG. 3 is a partial section view of the separator member in a retracted position separating the perforated lid from the main body portion of the box.
Figure 4:
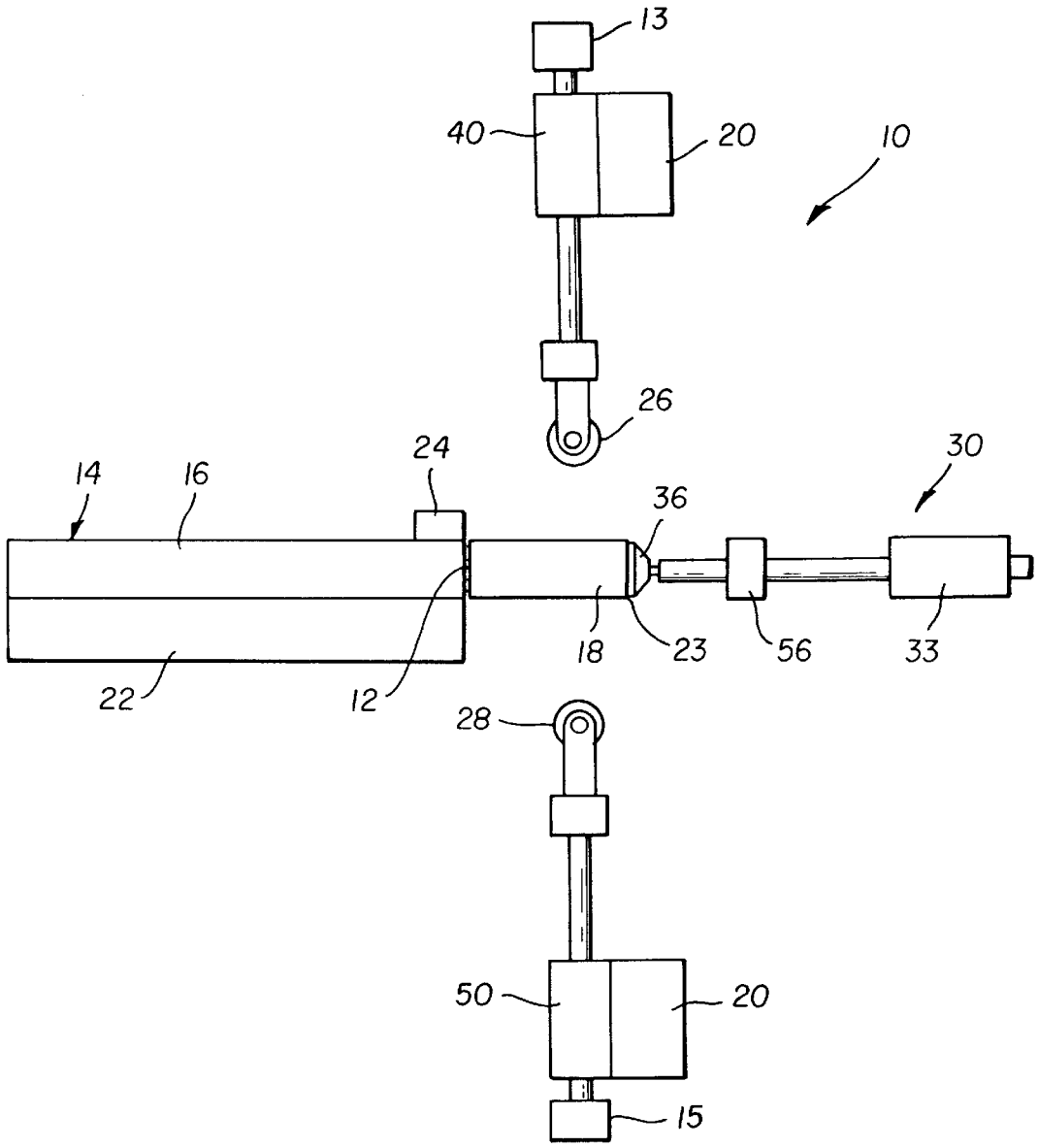
FIG. 4 is a schematic view of an alternative embodiment of the apparatus having a peel strip applicator.

Referring to FIGS. 2 and 3, a first retractable burst member 26 and an opposed second retractable burst member or roller 28 are arranged on the frame 20 for vertical movements toward and away from one another along a common axis passing through the first and second burst members. In this configuration, first and second retractable burst members 26, 28 are each arranged on frame 20 for applying a predetermined impact force on an end portion 17 of the perforated lid 18.

Figure 6:
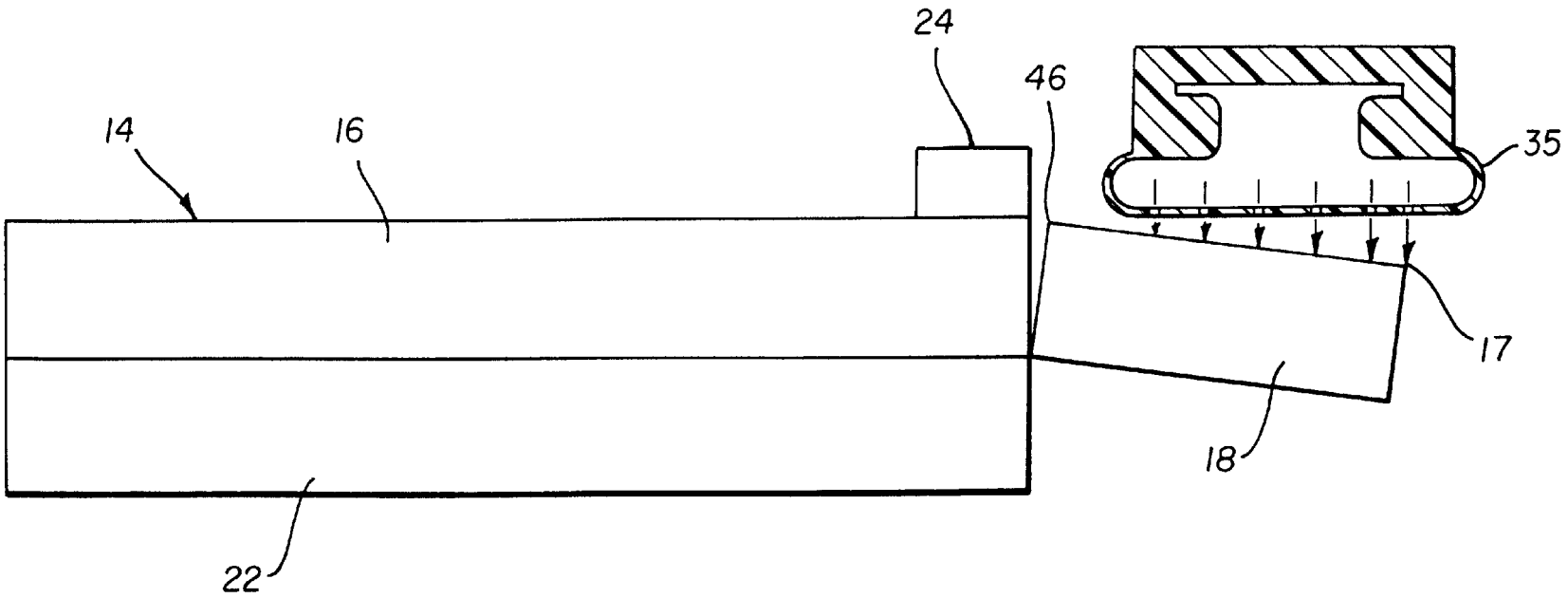
FIG. 6 is a partial side view of an alternative bursting member.

Alternatively, an air bladder 35 could be used to provide partially burst perforations, as shown in FIG. 6. Air impacts, shown by arrows in FIG. 6, would have the same effect as the first and second retractable burst members 26, 28. A stop member 13, 15 may be used to stop the movement of either pneumatic cylinder 40, 50, respectively, after the respective burst members 26, 28 engage the perforated lid 18.

Referring again to FIG. 4, a retractable separator member 30 is arranged on the frame 20 for capturing the perforated lid 18 and then separating the perforated lid 18 from the main body portion 16 at the at least partially burst perforations 12. In the preferred embodiment, separator member 30 comprises a first pneumatic cylinder 33 operably connected to a vacuum suction cup 36. Vacuum suction cup 36 is also connected to a source of vacuum (not shown) for grasping an end portion 23 of the perforated lid 18.

In FIGS. 1–3, means, such as second and third pneumatic cylinders 40, 50, is operably connected to the first and second retractable burst members 26, 28, respectively. Second pneumatic cylinder 40 moves the first retractable burst member 26 into engaging contact with end portion 17 of the perforated lid 18. After burst member 26 applies a predetermined impact force on end portion 17, second pneumatic cylinder 40 then retracts first burst member 26 vertically away from the perforated lid 18. This impact force produces at least partially burst first perforations 46 on the article 14 near where the first retractable burst member 26 impacted the perforated lid 18. Similarly, third pneumatic cylinder 50 is adapted to move second retractable burst member 28 into engaging contact with a predetermined impact force with an end portion 19 of perforated lid 18 opposite the end portion 17. As a result of this force of impact, at least partially burst second perforations 48 are produced nearest the second retractable burst member 28.

Referring to FIGS. 1–6, a vacuum sensor 56 is used to sense when the perforated lid 18 is actually separated from the main body portion 16 by the retractable separator member 30. Vacuum sensor 56 is operably connected proximate to the vacuum suction cup 36.

Figure 5:
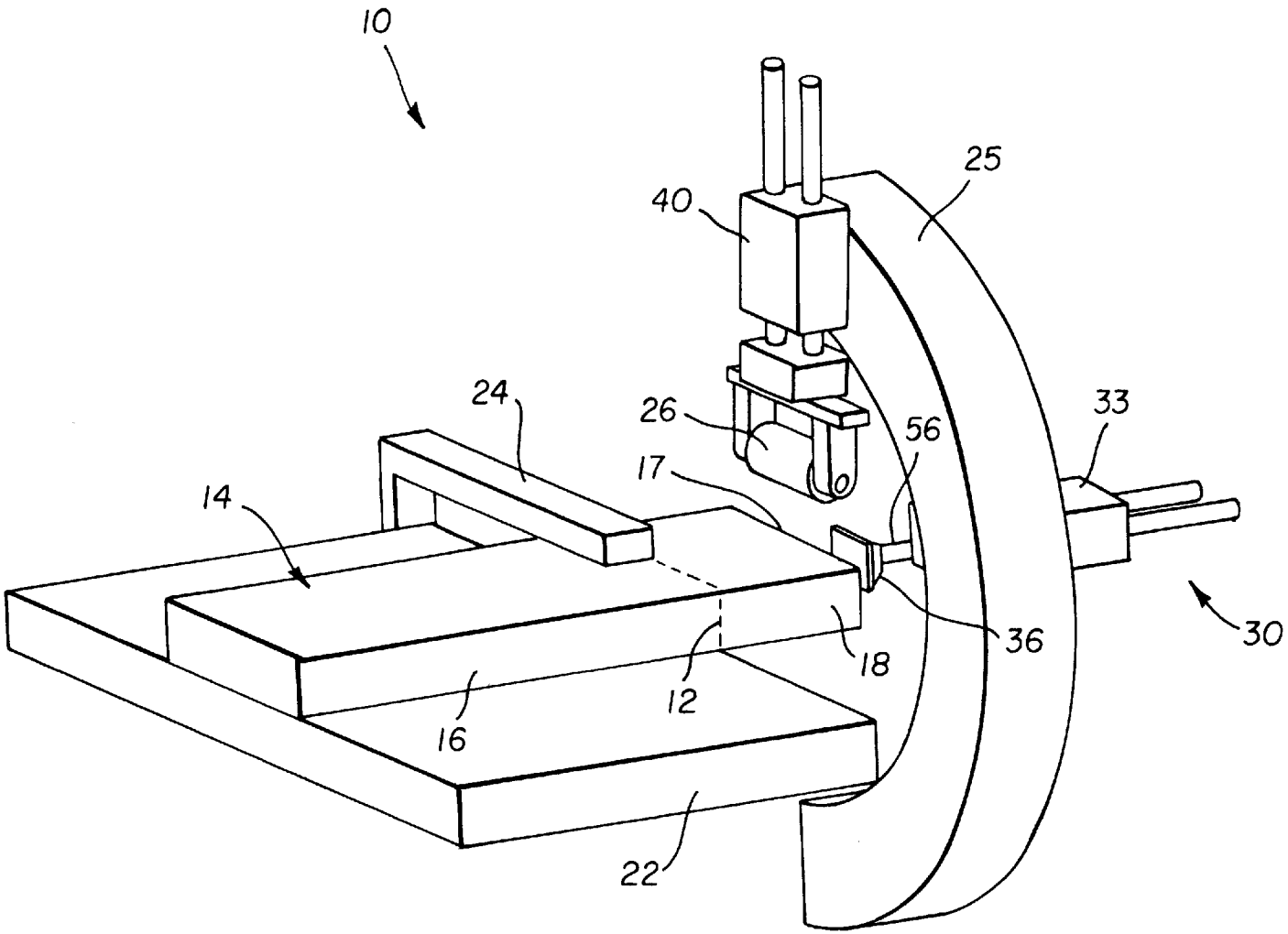
FIG. 5 is a side view of an alternative embodiment having a single, rotatable burst member for bursting perforations.

In operations, an article, for instance a corrugated box 14 having a perforated lid 18, is transported to the apparatus 10 of the invention and positioned properly between the first retractable burst member 26, the second retractable burst member 28, and the retractable separator member 30. A box clamp 24 may be used to hold the box 14 securely against the substantially flat moveable surface or platform 22. As shown in FIG. 2, the first retractable burst member 26 is extended against an end portion 17 of the perorated lid 18, breaking the top portions of perforations 12 and approximately 60% of the side portions perforations 12 of the perforated lid 18, then retracted. As shown in FIG. 3, the second retractable burst member 28 is extended against an end portion 19 opposite end portion 17 of the perforated lid 18, breaking the bottom perforations and the remaining side perforations, then retracted. Next, the separator member 30 is extended against the perforated lid 18 and vacuum is applied to the vacuum suction cup 36. The separator member 30 is then retracted, breaking any residual fibers and separating the perforated lid 18 from the main body portion 16 of the box 14. Once the separator member 30 is detected, retracted and vacuum is detected via the vacuum sensor 56, separation of the perforated lid 18 from the main body portion 16 of box 14 has been achieved. If either vacuum sensor 56 or retraction sensor (not shown) for detecting retraction of the pneumatic cylinder 33 does not properly detect appropriate signals, the perforated lid 18 has not been separated and the process could be retried. However, once the perforated lid 18 is successfully separated, separator member 30 is extended, vacuum is turned off, the separator member 30 is retracted, and the perforated lid 18 is now in position to have a peel seal label (not shown) applied. Referring to FIG. 5, the first and second retractable burst members 26 and 28 may be replaced by a single rotatable retractable burst member 26 arranged for rotating around the article to a predetermined position relative to the perforations 12 and for engageably contacting the article so as to apply a predetermined impact force on the perforations 12 at the predetermined position to form at least partially burst perforations. Means such as a second pneumatic cylinder 40 and rotary mechanism 25 are provided for moving the retractable burst member 26 into engaging contact with the perforations 12 of the perforated lid 18 for bursting perforations 12 nearest to the retractable burst member 26 and then for rotating the retractable burst member to a second position for engaging contact with remaining perforations 12.

The invention has been described with reference to a preferred embodiment. However, it will be appreciated that variations and modifications can be effected by a person of ordinary skill in the art without departing from the scope of the invention.

Parts List:

10 box bursting apparatus
12 perforations
13 stop member
14 corrugated box (article)
15 stop member
16 main body portion of box 14
17 end portion of the perforated lid 18 of box 14
18 perforated lid of box 14
19 end portion of the perforated lid 18 of box 14
20 frame
22 substantially flat moveable surface (platform)
23 end portion of the perforated lid 18
24 clamp
25 rotary mechanism
26 first retractable burst member (roller)
28 second retractable burst member (roller)
30 retractable separator member
33 first pneumatic cylinder
35 air bladder
36 vacuum suction cup
40 second pneumatic cylinder
46 partially burst first perforations
48 partially burst second perforations
50 third pneumatic cylinder
56 vacuum sensor

What is claimed is:

1. Apparatus for bursting perforations on an article having a main body portion and a perforated lid, said perforated lid being separable from said main body portion at perforations along the periphery of said main body portion, said apparatus comprising:

a frame having a substantially flat, movable surface for supporting said article with said perforations exposed for impact;

means for securing said article to said substantially flat, moveable surface; a rotatable, retractable burst member arranged for rotating around said article to a predetermined position relative to said perforations and for engageably contacting said article so as to apply a predetermined impact force on said perforations at said predetermined position to form at least partially burst perforations;

a retractable separator member arranged in said frame for capturing said perforated lid and then separating said perforated lid from said main body portion at said at least partially burst perforations;

means for moving said retractable burst member into engaging contact with said perforations of said perforated lid for bursting perforations nearest to said retractable burst member and then for rotating said retractable burst member to a second position for engaging contact with remaining perforations;

means for moving said retractable separator into a first position capturing said perforated lid about said partially burst perforations and then to a second position separating said perforated lid from said main body portion of said article.

2. The apparatus recited in claim 1 further comprising a sensor means arranged proximate to said retractable separator member for detecting said perforated lid separated from said main body portion of said article.

3. The apparatus recited in claim 1 wherein said retractable burst member comprises a generally cylindrical roller supported on a second pneumatic cylinder.

4. The apparatus recited in claim 1 further comprising a first stop member structurally associated with said retractable burst member for limiting displacement of said retractable burst member.

5. The apparatus recited in claim 1 wherein said separator member comprises a vacuum suction cup operably connected to a source of vacuum.

6. A method of opening a corrugated box having a perforated lid and a main body, said main body being separable from said perforated lid by perforations, said method comprising the steps of:

providing the apparatus recited in claim 1;

positioning an article on said substantially flat, moveable surface so as to expose said perforations to an impact force;

moving said substantially flat, moveable surface having said article thereon into a first position proximate to said retractable burst member;

moving said retractable burst member into engaging contact with an end portion of said perforated lid thereby forming at least partially burst first perforations;

retracting said retractable burst member from said perforated lid;

rotating said retractable burst member to an opposite side of said perforated lid;

moving said retractable burst member into engaging contact with an opposing end portion of said perforated lid thereby forming at least partially burst second perforations;

retracting said retractable burst member from said perforated lid;

moving said retractable burst into a first position capturing an end of said perforated lid; and, retracting said retractable separator to a second position thereby separating said perforated lid from said main body portion at said at least partially burst first and second perforations.

7. The method recited in claim 6 wherein the steps of moving said retractable burst member into engaging contact includes the step of applying a predetermined impact force on respective end portions of said perforated lid.

* * * * *